US009204695B2

(12) United States Patent
Van Loosbroek

(10) Patent No.: US 9,204,695 B2
(45) Date of Patent: Dec. 8, 2015

(54) COMBINED PARASOL AND STORAGE HOUSING ASSEMBLY, AND METHOD OF MANUFACTURING THE STORAGE HOUSING

(71) Applicant: Unilux IP B.V., Boxtel (NL)

(72) Inventor: Patrick Franciscus Johannes Van Loosbroek, Boxtel (NL)

(73) Assignee: Unilux IP B.V., Boxtel (NL)

( * ) Notice: Subject to any disclaimer, the term of this patent is extended or adjusted under 35 U.S.C. 154(b) by 0 days.

(21) Appl. No.: 13/777,152

(22) Filed: Feb. 26, 2013

(65) Prior Publication Data

US 2013/0220391 A1 Aug. 29, 2013

(30) Foreign Application Priority Data

Feb. 27, 2012 (NL) ..... 2008363

(51) Int. Cl.
*A45B 25/24* (2006.01)
*A45B 11/00* (2006.01)
(Continued)

(52) U.S. Cl.
CPC ..... *A45B 11/00* (2013.01); *A45B 19/00* (2013.01); *A45B 23/00* (2013.01); *A45B 25/24* (2013.01);
(Continued)

(58) Field of Classification Search
CPC ..... A45B 3/10; A45B 7/00; A45B 11/00; A45B 2023/0031; A45B 1/00; A45B 25/24; A45B 23/00; A45B 19/00; A45B 2023/0025; A45B 2023/0037; A45B 2019/002; E04H 15/04; E04H 15/28
USPC ..... 135/90, 96, 119, 120.4, 21, 34.2, 135/88.11–88.12, 98, 120.41, 20.3, 16; 52/63, 86, 222; 114/361; 4/498, 4/500–503; 254/286, 394; 160/22, 23.1
See application file for complete search history.

(56) References Cited

U.S. PATENT DOCUMENTS 373,809 A * 11/1887 Blunt ..... 135/98
442,991 A 12/1890 Mckevit
(Continued)

FOREIGN PATENT DOCUMENTS

DE 3808529 C1 5/1989
EP 595665 A1 * 5/1994 ..... A45B 23/00
EP 1621098 A2 2/2006

OTHER PUBLICATIONS

Dutch Search Report—NL 2008363—Date of completion: Nov. 16, 2012.

*Primary Examiner* — Winnie Yip
(74) *Attorney, Agent, or Firm* — Banner & Witcoff, Ltd.

(57) ABSTRACT

A combined parasol and storage housing assembly (1) includes an expandable and collapsible shielding member (7) and a substantially hollow storage housing (3). The storage housing (3) is suitable for storing the shielding member (7) in its collapsed condition. The storage housing (3) further comprises a spine (15) and an elongated cover sheet (33). The cover sheet (33) is formed with a pair of substantially opposite longitudinal edges. Each edge of the pair of substantially opposite longitudinal edges is mounted to the spine (15) to form the storage housing. The cover sheet (33) is formed by cutting a sheet of flexible and resilient material to a length in accordance with a longitudinal size of the shielding member (7) in its collapsed state. The spine (15) is formed by cutting a length of rigid material, having a substantially continuous constant cross section, to a length in accordance with the longitudinal size of the shielding member (7) in its collapsed state.

19 Claims, 5 Drawing Sheets

(51) Int. Cl.
*B31B 1/20* (2006.01)
*A45B 19/00* (2006.01)
*A45B 23/00* (2006.01)

(52) U.S. Cl.
CPC ..... *B31B 1/20* (2013.01); *A45B 2019/002* (2013.01); *A45B 2023/0025* (2013.01); *A45B 2023/0037* (2013.01)

(56) References Cited

U.S. PATENT DOCUMENTS 2,183,833 A * 12/1939 Farhar ..... 135/20.3
2,688,973 A * 9/1954 Reiman ..... 135/156
3,333,594 A * 8/1967 Moss ..... 135/88.14
5,269,332 A * 12/1993 Osborne ..... 135/88.01
5,443,086 A 8/1995 Muller
5,785,069 A * 7/1998 Glatz ..... 135/20.1
5,845,665 A * 12/1998 Koehn ..... 135/98
6,142,209 A * 11/2000 Girard ..... 160/22
6,988,504 B1 * 1/2006 Goldwitz ..... 135/20.1
7,461,665 B2 * 12/2008 Koehn ..... 135/21
7,520,289 B1 * 4/2009 Barber ..... 135/21
7,523,759 B2 4/2009 van Loosbroek
2002/0144340 A1 * 10/2002 Last ..... 4/502
2006/0185704 A1 * 8/2006 Guo et al. ..... 135/96

* cited by examiner

COMBINED PARASOL AND STORAGE HOUSING ASSEMBLY, AND METHOD OF MANUFACTURING THE STORAGE HOUSING

CROSS-REFERENCE TO RELATED APPLICATIONS

This application claims priority under 35 U.S.C. §119 to Application NL 2008363, filed Feb. 27, 2012, which is hereby incorporated by reference in its entirety.

The invention relates to a combined parasol and storage housing assembly. More in particular the invention relates to a parasol assembly that includes an expandable and collapsible shielding member and a substantially hollow storage housing. The storage housing is suitable for storing the shielding member in a collapsed condition.

Such a parasol assembly is known from U.S. Pat. No. 7,523,759. This known assembly is provided with a shielding member that can assume a folded-out, expanded condition and a collapsed condition. A housing is provided in which the shielding member is received in its collapsed condition. In its folded-out condition the shielding member is located outside the housing. It can be convenient to manufacture such parasol assemblies in a number of predetermined sizes, or even make these to measure for specific applications. The known parasol assemblies have sometimes caused difficulties in this respect, because each and every differently sized screening member has required its own size of sleeve-shaped housing to accommodate the collapsed shielding member in its entirety. The prior art housing, being a one-piece tubular element therefore needed to be provided in several different lengths and diameters. When the size of the shielding member increases, so does not only its length, but also its diameter in the collapsed condition. Another occasional inconvenience with the prior art housing has been that it supports the entire weight during and upon retraction of the shielding member therein. This has also required a rather sturdy housing that easily causes a weight penalty in at least the larger sizes of such parasol assemblies.

Accordingly it is an object of the present invention to propose an improved parasol assembly of the type referred to herein above that notably will allow efficient manufacturing of a size adapted storage housing, as well as providing efficient operation. In a more general sense it is an object of the invention to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice that was not before available. To this end the invention provides for a parasol assembly including a expandable and collapsible shielding member and a substantially hollow storage housing, suitable for storing the shielding member in its collapsed condition, the storage housing comprising a spine and an elongated cover sheet having a pair of substantially opposite longitudinal edges, and wherein each edge of the pair of substantially opposite longitudinal edges is mounted to the spine. By making the housing in two parts it has now become very easy to manufacture storage housings in different sizes and also with a minimum of scrap. With such a parasol assembly it is also convenient when the spine comprises a pair of longitudinal groves, directed oppositely outwardly, each longitudinal groove receiving one of the opposite longitudinal edges of the cover sheet. Connecting the cover sheet to the spine is thereby made easy and neat. In this regard it is also advantageous when the cover sheet is made from a flexible and resilient material. The inherent resiliency then assists in retaining the opposite edges of the cover sheet in the groves of the spine. It may also have preference when the cover sheet is made of aluminium, which is light, not prone to corrosion and has the necessary resilience.

It is further advantageous when the spine is manufactured from a rigid material, in particularly when the spine also has a substantially continuous constant cross section. Such a rigid material can be easily cut to the required length for a required storage housing, without requiring any further adaptations. Conveniently the spine can be made from aluminium, as an extrusion.

As is common for parasol assemblies of this type, the shielding member is preferably movably articulated to the storage housing. This enables the shielding member when expanded to assume a horizontal position irrespective of the elevation angle of the storage housing. The storage housing in use will be mounted with a proximal end thereof to a wall or ceiling surface, or from a pole or mast, and will be at a downward inclination. Furthermore the articulated connection will provide protection against damage when the expanded shielding member is exposed to wind or mechanical impact. It is further advantageous when the shielding member is articulated to a carriage that is movable longitudinally of and within the storage housing, in particular when the spine also supports the carriage for movement along the spine. Such an arrangement relieves the housing of at least an important portion of the weight of the shielding member when collapsed and stored in the housing. In this regard it would be preferred for the spine to comprise a rail. When the spine is provided with a rail it may also be preferred for the carriage to be provided with a trolley wheel that is received by that rail, to allow the carriage and shielding member to be movable along the rail.

In general it may also be preferred for the parasol assembly to further include operating means for moving the carriage along the storage housing. Such operating means may conveniently include a first return pulley mounted to the spine inside the storage housing near a free open distal end thereof and a winding spool mounted inside the storage housing near an opposite proximal end thereof. Apart from an option of manually actuating the operating means, it is of further advantage when the operating means include an electric drive motor. Advantageously the electric motor and other components of the operating means are also supported from the spine, so that the cover sheet has only a minimum of weight to support.

The shielding member when it comprises a shielding cloth supported by a plurality of ribs, these ribs may conveniently each be hinged to a mounting hub and the mounting hub may then advantageously be connected to the carriage by means of a universal joint. The plurality of ribs may then also be connected to a collar by a plurality of hinged links, and wherein the collar is arranged to move towards and away from the mounting hub, for expanding and collapsing the shielding member.

In particular the spine may further conveniently comprise an undercut slot open to an exterior of the storage housing for accepting at least one of a variety of brackets. Such at least one of a variety of brackets is advantageously one of a suspension hanger and a mounting strip for mounting the storage housing to a wall, a ceiling, or a post.

The storage housing preferably has a free distal end and a proximal end for mounting, these ends are preferably also substantially circular and open, while the proximal end may conveniently be closed off by an end plug.

Further the invention also provides for a method for manufacturing the storage housing suitable for use in the parasol assembly according to any one of the above recited embodiments, this method preferably including:

providing perimeter and longitudinal sizes of a given expandable and collapsible shielding member measured in its collapsed state, providing a length of rigid material having a substantially continuous constant cross section, providing a sheet of flexible and resilient material, forming a pair of opposite longitudinal edges to the sheet of flexible and resilient material by cutting it to a width in accordance with the perimeter size of the given shielding member, forming the cover sheet by cutting the sheet of flexible and resilient material to a length in accordance with the longitudinal size of the given shielding member, forming a spine by cutting the length of rigid material to a length in accordance with the longitudinal size of the given shielding, and mounting each edge of the pair of opposite longitudinal edges to the spine. In this regard it is also advantageous when the step of mounting each edge of the pair of opposite longitudinal edges to the spine includes at least one of gluing, bonding, stapling, and screwing.

Further advantageous aspects of the invention will become clear from the appended description and in reference to the accompanying drawings, in which.

Figure 1:
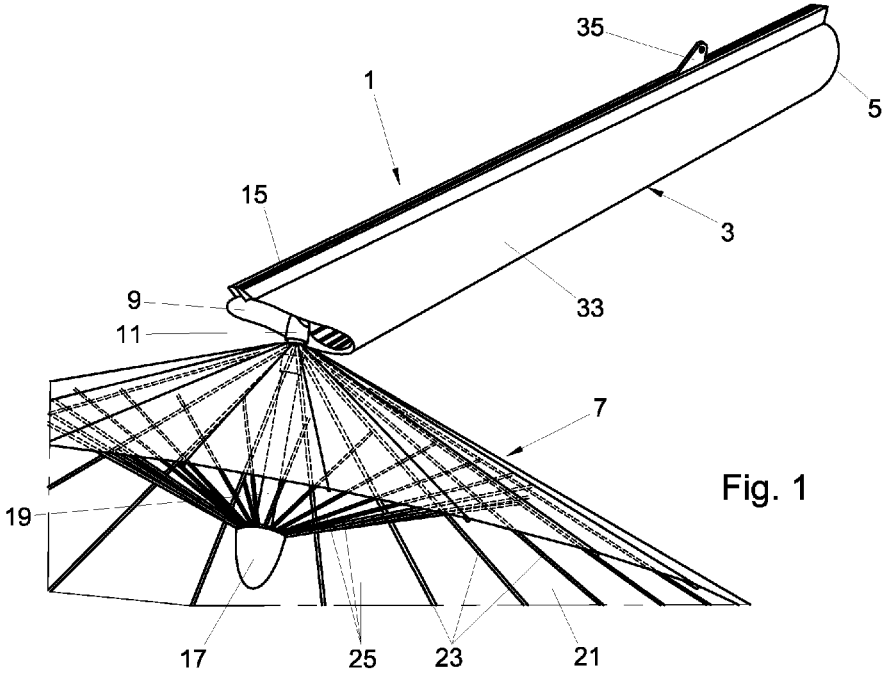
FIG. 1 is a parasol assembly according to the invention in its position extended from its storage housing.
Figure 2:
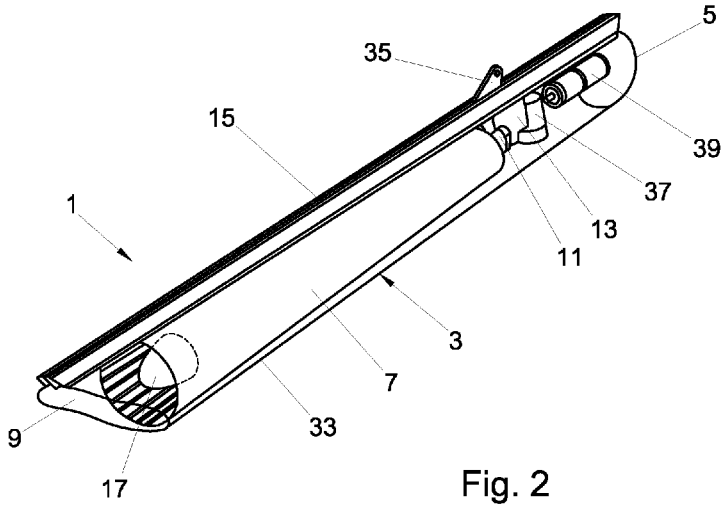
FIG. 2 is a ghost view of the parasol of FIG. 1 in its condition in which it is retracted into its storage housing.

A parasol assembly 1 according to the present invention is illustrated in FIG. 1. Where in this description reference is made to "parasol", this expression is understood to include also like structures such as umbrellas, irrespective of whether these structures are intended to shield against sun, rain, wind or sight for privacy. The parasol assembly 1 in FIG. 1 is shown in an extended position, while in FIG. 2 it is shown in a retracted condition. The parasol assembly 1 includes a storage housing 3 that can be mounted to a wall, ceiling or post from a first, proximal end 5. A collapsible and expandable shielding member 7 is adapted to extend from a second free open, distal end 9 of the storage housing 3 in an expanded condition. The shielding member 7, as shown in FIG. 2, is also adapted of being withdrawn into the storage housing 3 through the free open end 9 thereof. The shielding member 7 has a mounting hub 11 that is connected to a carriage 13 through a suitable articulation. The carriage 13 and thereby the mounting hub 11 are moveable along a spine 15. The shielding member 7 has a collar 17 that is moveable away from the mounting hub 11 for collapsing the shielding member 7 and moveable towards the mounting hub 11 for expanding the shielding member 7. Movement of the collar 17 towards and away from the mounting hub 11 is guided by a shaft 19, which may be a telescopic shaft. The shielding member 7 has a shielding cloth 21 that is supported by a plurality of ribs 23. The ribs 23 are hinged to the mounting hub 11 to pivot between a first position in which the ribs 23 extend generally radially from the hub 11, a shown in FIG. 1, and a second position in which the ribs 23 extend substantially parallel to one another as shown in FIG. 2.

Figure 3:
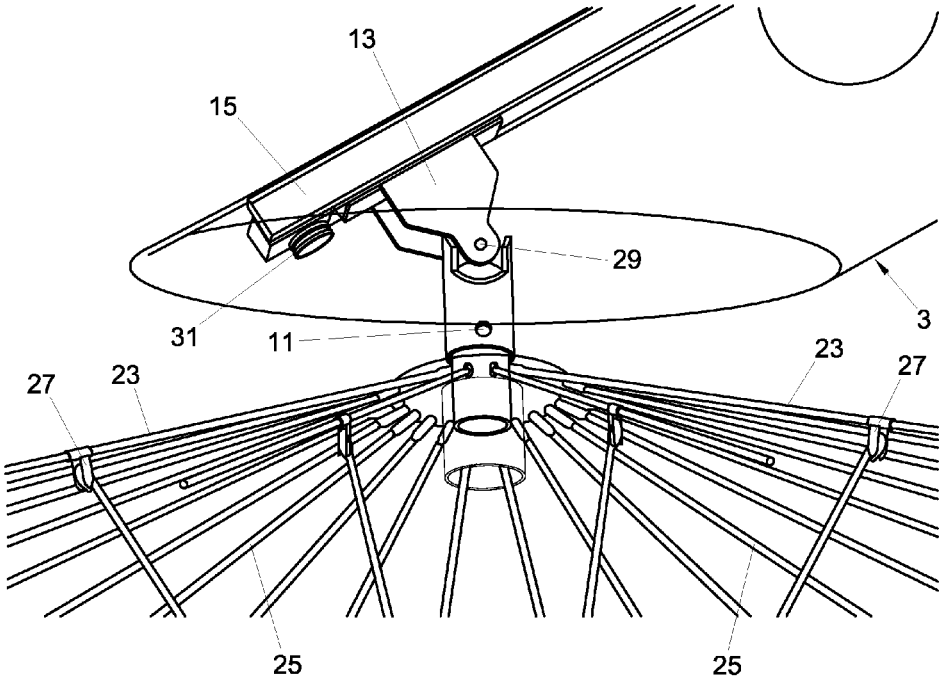
FIG. 3 is a partial detail view showing the mounting hub area of FIG. 1.
Figure 4:
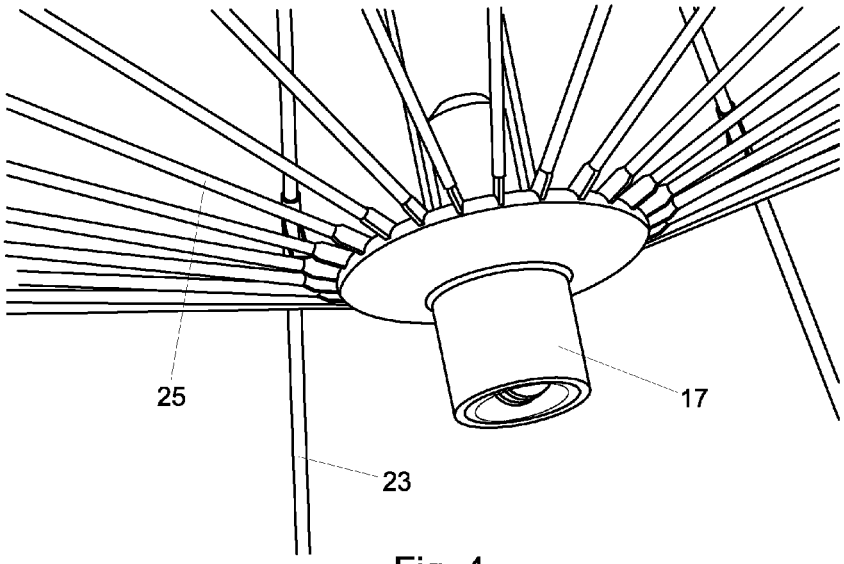
FIG. 4 is a partial detail view showing the central collar of the parasol in the position of FIG. 1.

As best shown in FIGS. 3 and 4 the ribs 23 are connected to the collar 17 by means of links 25 and hinges 27. The links 25 are also hinged to the collar 17 to pivot between a first position in which the links 25 extend generally radially from the collar 17 and a second position in which the links 25 extend generally parallel to one another. In the first position of the links 25 the shielding member 7 is extended, while in the second position of the links 25 the shielding member 7 is collapsed. In FIG. 3 it is further seen that the mounting hub 11 is articulated to the carriage 13 by means of a universal joint 29, which allows the shielding member 7 to be aligned with the longitudinal extend of the storage housing 3 upon being retracted therein. When extended from the storage housing 3 and expanded, the shielding member 7 will also benefit from the articulation by the universal joint 29 in being flexible under windy conditions. At the free end of the storage housing 3, the spine 15 is provided with a first return pulley 31 for an operating cord or cable (not shown, but conventional) to move the carriage 13 along a guiding means, such as a rail, associated with the spine 15. The guiding means for holding and guiding the carriage 13 can be formed integrally with the spine 15 and is positioned on an interior side of the storage housing 3. The storage housing 3 as seen in any one of the FIGS. 1 to 3 is completed by a cover 33 that attaches to the spine 15. Further a suspension hanger 35 may be attached to the exterior of the spine 15 to assist in attaching the parasol assembly 1 to a wall, ceiling or post. The storage housing 3 within an interior defined by the cover 33 and spine 15 also houses a winding spool 37 for winding the cable or cord that thereby moves the carriage 13 along the spine 15. An electric drive motor 39 may be provided to rotate the winding spool 37 in a selective one of two opposite directions of rotation.

Figure 5:
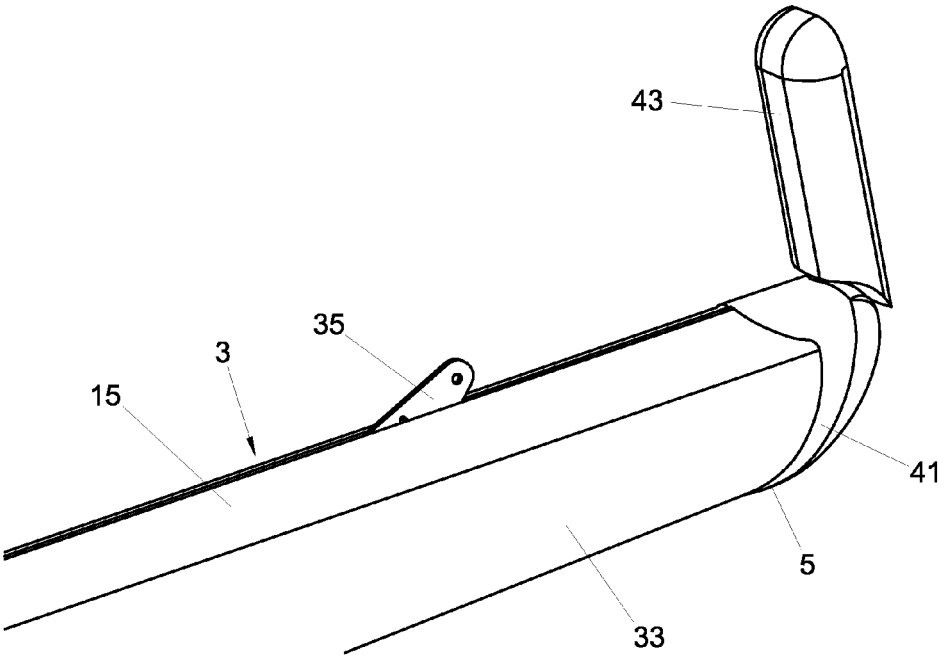
FIG. 5 is a partial view of a mounting area of the storage housing of FIGS. 1 and 2.

As further seen in FIG. 5 the mounting of the storage housing 3 may include an end plug 41 providing a covered mounting strip 43. A tensioning cable or strap (not shown but conventional) may extend between suspension hanger 35 and a mounting point on a wall, ceiling, or post to which also the mounting strip 43 is fastened. Thereby angular adjustment may be obtained for the storage housing 3, with respect to a wall, ceiling, or post from which it is mounted.

Figure 6:
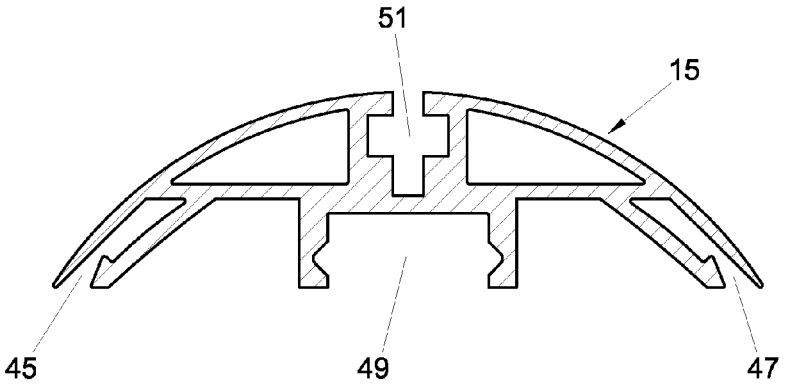
FIG. 6 is an end view of a spine part of the storage housing.

FIG. 6 illustrates the spine 15 in an end view. The spine 15 can be conveniently formed as an extrusion that can be cut to length subject to requirement. As will be clear, the length of the storage housing 3 between its first end 5 and its free second, distal end 9 may vary with the diametrical size of the shielding member 7 as required in its expanded condition. The cover 33 that completes the housing is preferably formed from a flexible resilient sheet material, which has its longitudinal edges engaged in opposite lateral grooves 45, 47 of the spine 15. Also a flexible sheet from which the cover 33 is formed can be easily cut to a required length. On an interior (lower) side of the spine 15 a rail 49 is formed along which the carriage 13 can be moved. On an exterior (upper) side of the spine 15 an undercut slot 51 is formed in which the suspension hanger 35 can be engaged and attached. Clearly the undercut slot 51 is also suitable for accepting a variety of brackets, such as a the mounting strip (43), or for mounting a tensioning cable or strap directly.

Figure 8:
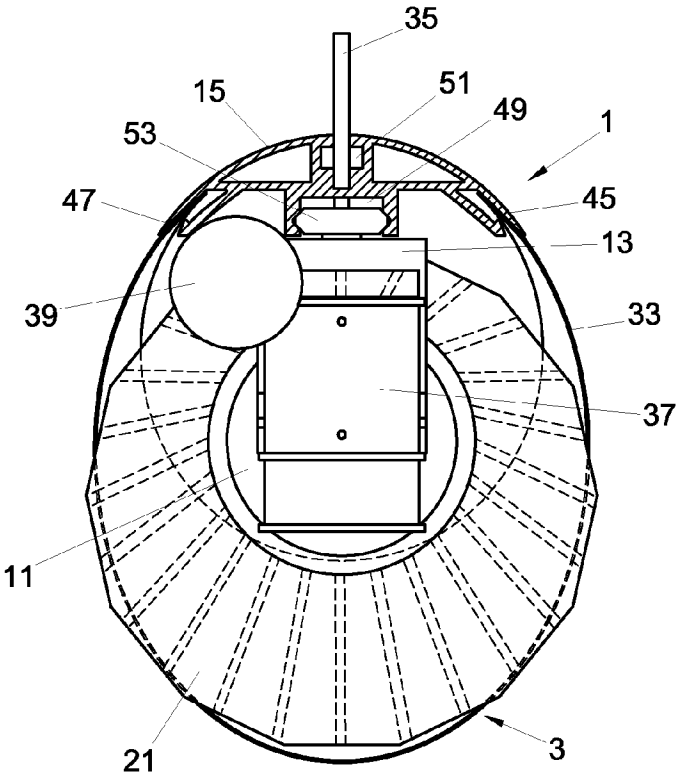
FIG. 8 is an end view opposite to that of FIG. 7, from a mounting end of the storage housing.
Figure 7:
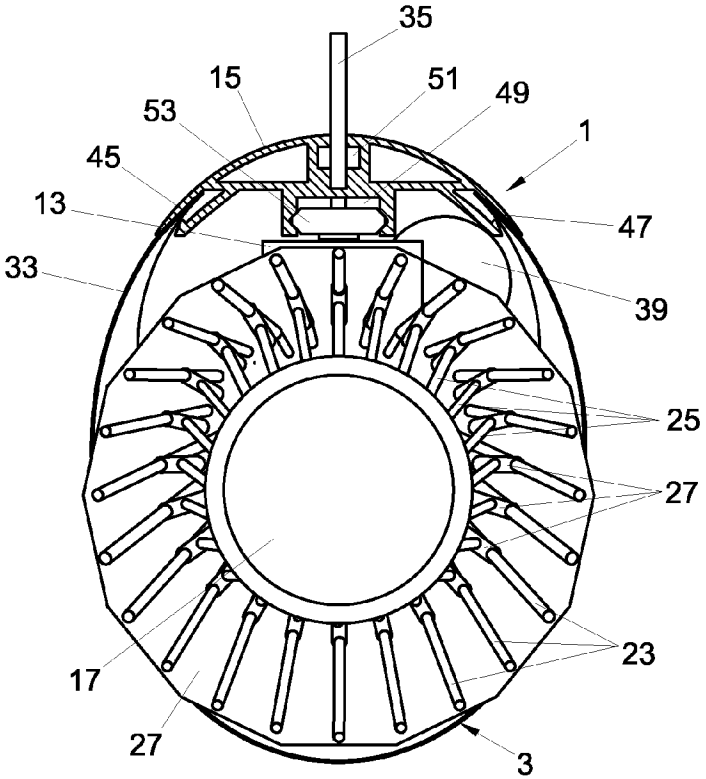
FIG. 7 is an end view of the storage housing with the parasol retracted, as in FIG. 2, from its free end.

FIGS. 7 and 8 are opposite end views of the parasol assembly 1 with its shielding member 7 stored in the storage housing 3. In these FIGS. 7 and 8 it can be clearly seen that longitudinal edges of the cover 33 are engaged in the opposite lateral grooves 45, 47 of the spine 15 to complete the storage housing 3. Mounting of each the opposite longitudinal edges to the spine 15 may also include gluing, bonding, stapling, riveting, and/or screwing.

Reference numerals indicated in FIGS. 7 and 8 are commensurate with the previous description of FIGS. 1 to 6. Additionally it is seen in FIGS. 7 and 8 that the carriage 13 is engaged in the rail 49 by a trolley wheel 53.

Figure 9:
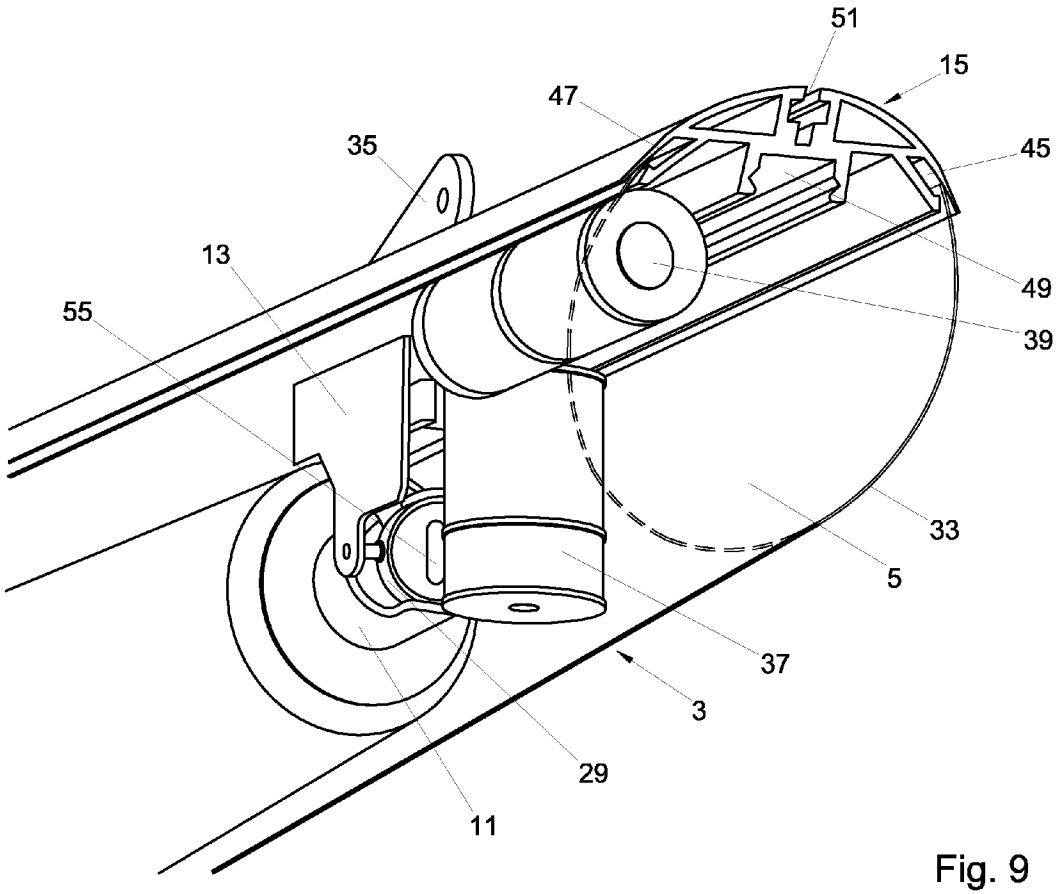
FIG. 9 is an enlarged detail of the mounting end of the storage housing in ghost view, showing the drive mechanism.

Referring now to FIG. 9 the first end 5 of the storage housing 3 is shown in greater detail. In this portion of the storage housing 3 the electric motor 39 is accommodated. The electric motor 39 can be mounted from the rail 49, which in an end portion of the spine 15 that is not used for the travel of the carriage 13. The electric motor 39 drives the winding spool 37 through a suitable, but conventional gearing, and a cable or cord (not shown but conventional) is wrapped about the winding spool 37 for moving the carriage 13 in opposite directions along the rail 49 of the spine 15. A second pulley wheel 55 is provided in the universal joint 29 for guiding the operating cable or cord. The operating cord will be generally similar to that described in U.S. Pat. No. 7,523,759 and a further description in the present disclosure is deemed redundant. The present disclosure is primarily concerned with a particularly advantageous arrangement of components and arrangement of parts that form the parasol assembly 1 and its storage housing 3.

It should also be noticed that the flexible and preferably resilient sheet material that forms the cover 33, can be so formed that the storage housing 3 adapts a slight conical shape to be commensurate with the shape of the collapsed shielding member 7. This can be done by having the longitudinal edges of the sheet material that forms the cover 33, slightly converge, rather than being parallel. A suitable sheet material for the cover may be an aluminium, steel or plastic sheet material. Such a material is easily cut to size and contoured as required. In particular the first and second end 5, 9 may be contoured to attain a particular shape when curved with the longitudinal edges connected to the spine 15.

While it has been described that the first end 5 is finished by receiving an end plug 41, it is likewise possible for the second open end 9 to receive a collar out of low friction material to protect the shielding cloth 21, when the shielding member 7 is withdrawn into the storage housing 3. Thereby friction may be limited as much as possible when the shielding member 7 is being moved into the housing, in particular if the free end face of the storage housing 3 is also given a rounding. Collapsing of the shielding member 7 can entirely be induced by the second open end 9 forcing the shielding member 7 and its ribs 23 into their second position when these are substantially parallel to one another. To allow this movement to take place the telescopic shaft 19 can be resiliently extended to allow the collar 17 to move away from the mounting hub 11. Also an elastic member, such as a tension spring, may be used to bias the collar 17 and mounting hub 11 towards one another.

As a further useful embodiment the collar 17 can also be provided with a lamp, so that the parasol 1 may also serve as a lighting element. When such a lamp is associated with the collar 17 the lighting function is available in both the extended (FIG. 1), as in the retracted condition (FIG. 2). It is also possible that the lamp associated with the collar 17 takes the function of a halogen heating element, which is useful when the parasol is extended. When the second open end 9 of the storage housing 3 is provided with a collar to protect the shielding cloth 21, then a strip of LED lights may be incorporated in this collar. Thereby the parasol 1 is functioning as a lighting device when the shielding cloth 21 is retracted, and there will be a decorative lighting of the shielding cloth 21 from above when in extended condition.

Thus is described a combined parasol and storage housing assembly 1 that includes an expandable and collapsible shielding member 7 and a substantially hollow storage housing 3. The storage housing 3 is suitable for storing the shielding member 7 in its collapsed condition. The storage housing 3 further comprises a spine 15 and an elongated cover sheet 33. The cover sheet 33 is formed with a pair of substantially opposite longitudinal edges. Each edge of the pair of substantially opposite longitudinal edges is mounted to the spine 15 to form the storage housing. The cover sheet 33 is formed by cutting a sheet of flexible and resilient material to a length in accordance with a longitudinal size of the shielding member 7 in its collapsed state. The spine 15 is formed by cutting a length of rigid material, having a substantially continuous constant cross section, to a length in accordance with the longitudinal size of the shielding member 7 in its collapsed state.

It is thus believed that the operation and construction of the present invention will be apparent from the foregoing description and drawings appended thereto. It will be clear to the skilled person that the invention is not limited to any embodiment herein described and that modifications are possible which should be considered within the scope of the appended claims. Also kinematic inversions are considered inherently disclosed and to be within the scope of the invention. In the claims, any reference signs shall not be construed as limiting the claim. The term 'comprising' and 'including' when used in this description or the appended claims should not be construed in an exclusive or exhaustive sense but rather in an inclusive sense. Thus the expression 'comprising' as used herein does not exclude the presence of other elements or steps in addition to those listed in any claim. Furthermore, the words 'a' and 'an' shall not be construed as limited to 'only one', but instead are used to mean 'at least one', and do not exclude a plurality. Features that are not specifically or explicitly described or claimed may be additionally included in the structure of the invention within its scope. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. Additions, deletions, and modifications within the purview of the skilled person may generally be made without necessarily departing from the scope of the invention, as is determined by the claims.

The invention claimed is:

1. Parasol assembly including an expandable and collapsible shielding member and a substantially hollow storage housing, suitable for storing the shielding member in its collapsed condition, the storage housing comprising a spine and an elongated cover sheet having a pair of substantially opposite longitudinal edges, wherein each edge of the pair of substantially opposite longitudinal edges is mounted to the spine, and wherein the spine comprises a pair of longitudinal groves, directed oppositely outwardly, each longitudinal groove receiving one of the opposite longitudinal edges of the cover sheet.

2. Parasol assembly according to claim 1, wherein the cover sheet is made from a flexible and resilient material.

3. Parasol assembly according to claim 1, wherein the cover sheet is made of aluminium.

4. Parasol assembly according to claim 1, wherein the spine is manufactured from a rigid material.

5. Parasol assembly according to claim 1, wherein the spine has a substantially continuous constant cross section.

6. Parasol assembly according to claim 1, wherein the spine is made from aluminium.

7. Parasol assembly according to claim 1, wherein the shielding member is movably articulated to the storage housing.

8. Parasol assembly according to claim 7, wherein the shielding member is articulated to a carriage that is movable longitudinally of and within the storage housing.

9. Parasol assembly according to claim 8, wherein the spine supports the carriage for movement along the spine.

10. Parasol assembly according to claim 8, wherein the spine comprises a rail.

11. Parasol assembly according to claim 8, further including operating means for moving the carriage along the storage housing.

12. Parasol assembly according to claim 1, wherein the storage housing has a free distal end and a proximal end for mounting, the ends are substantially circular and open, the proximal end is closed off by an end plug.

13. Parasol assembly including an expandable and collapsible shielding member and a substantially hollow storage housing, suitable for storing the shielding member in its collapsed condition, the storage housing comprising a spine and an elongated cover sheet having a pair of substantially opposite longitudinal edges, wherein each edge of the pair of substantially opposite longitudinal edges is mounted to the spine, wherein the shielding member is articulated to a carriage that is movable longitudinally of and within the storage housing, wherein the spine comprises a rail, and wherein the carriage is provided with a trolley wheel that is received by the rail, for allowing the carriage and shielding member to be movable along the rail.

14. Parasol assembly including an expandable and collapsible shielding member and a substantially hollow storage housing, suitable for storing the shielding member in its collapsed condition, the storage housing comprising a spine and an elongated cover sheet having a pair of substantially opposite longitudinal edges, wherein each edge of the pair of substantially opposite longitudinal edges is mounted to the spine, and wherein the shielding member is articulated to a carriage that is movable longitudinally of and within the storage housing, the parasol assembly further including operating means for moving the carriage along the storage housing, wherein the operating means include a first return pulley mounted to the spine inside the storage housing near a free open distal end thereof and a winding spool mounted inside the storage housing near an opposite proximal end thereof.

15. Parasol assembly including an expandable and collapsible shielding member and a substantially hollow storage housing, suitable for storing the shielding member in its collapsed condition, the storage housing comprising a spine and an elongated cover sheet having a pair of substantially opposite longitudinal edges, wherein each edge of the pair of substantially opposite longitudinal edges is mounted to the spine, and wherein the shielding member is articulated to a carriage that is movable longitudinally of and within the storage housing, the parasol assembly further including operating means for moving the carriage along the storage housing, wherein the operating means include an electric drive motor.

16. Parasol assembly including an expandable and collapsible shielding member and a substantially hollow storage housing, suitable for storing the shielding member in its collapsed condition, the storage housing comprising a spine and an elongated cover sheet having a pair of substantially opposite longitudinal edges, wherein each edge of the pair of substantially opposite longitudinal edges is mounted to the spine, wherein the shielding member is articulated to a carriage that is movable longitudinally of and within the storage housing, and wherein the shielding member comprises a shielding cloth supported by a plurality of ribs that are each hinged to a mounting hub and wherein the mounting hub is connected to the carriage by means of a universal joint.

17. Parasol assembly according to claim 16, wherein the plurality of ribs are connected to a collar by a plurality of links, and wherein the collar is arranged to move towards and away from the mounting hub.

18. Parasol assembly including an expandable and collapsible shielding member and a substantially hollow storage housing, suitable for storing the shielding member in its collapsed condition, the storage housing comprising a spine and an elongated cover sheet having a pair of substantially opposite longitudinal edges, wherein each edge of the pair of substantially opposite longitudinal edges is mounted to the spine, wherein the spine further comprises an undercut slot open to an exterior of the storage housing, the undercut slot having therein at least one bracket.

19. Parasol assembly according to claim 18, wherein the at least one bracket is a suspension hanger or a mounting strip.

* * * * *